US005307990A

United States Patent [19]

Adams et al.

[11] Patent Number: 5,307,990

[45] Date of Patent: May 3, 1994

[54] ADAPTIVE FORCED WARM AIR FURNACE USING ANALOG TEMPERATURE AND PRESSURE SENSORS

[75] Inventors: Wilmer L. Adams, Fridley; Ralph H. Torborg, Minnetonka, both of Minn.

[73] Assignee: Honeywell, Inc., Minneapolis, Minn.

[21] Appl. No.: 973,793

[22] Filed: Nov. 9, 1992

[51] Int. Cl.[5] ..... F24F 7/00

[52] U.S. Cl. ..... 236/11; 236/37; 236/49.3

[58] Field of Search ..... 236/49.3, 11, 37

[56] References Cited

U.S. PATENT DOCUMENTS

| | | | |
|---|---|---|---|
| 2,504,315 | 4/1950 | Feuerfile | 236/11 UX |
| 3,653,589 | 4/1972 | McGrath | 236/49.3 |
| 3,653,590 | 4/1972 | Elsea | 236/49.3 |
| 4,330,260 | 5/1982 | Jorgensen et al. | 431/12 |
| 4,406,397 | 9/1983 | Kamata et al. | 236/1 B |
| 4,487,363 | 12/1984 | Parker et al. | 236/49 |
| 4,492,560 | 1/1985 | Sundberg | 431/12 |
| 4,583,936 | 4/1986 | Krieger | 431/1 |
| 4,676,734 | 6/1987 | Foley | 431/12 |
| 4,703,747 | 11/1987 | Thompson et al. | 126/112 |
| 4,718,021 | 1/1988 | Timblin | 364/505 |
| 4,795,088 | 1/1989 | Kobayashi et al. | 236/49 |
| 4,842,510 | 6/1989 | Grunden et al. | 431/19 |

*Primary Examiner*—William E. Wayner
*Attorney, Agent, or Firm*—Ian D. MacKinnon

[57] ABSTRACT

Furnace control for a forced air furnace utilized in multi-zone heating. The forced air furnace is made up of return ducts, a heat exchanger, warm air ducts, a circulation blower, and a burner. The forced air furnace receives heating requests from external control means wherein the furnace provides heat to a zone or multiple zones to be heated. The control for the furnace comprises a temperature sensor for sensing the temperature of the heat exchanger, a regulator for regulating the burner to hold the temperature at the heat exchanger constant during the on cycle of the furnace, a pressure sensor for measuring the pressure in the heat exchanger and a controller for controlling the circulation blower in order to maintain a constant pressure within the heat exchanger.

7 Claims, 3 Drawing Sheets

ADAPTIVE FORCED WARM AIR FURNACE USING ANALOG TEMPERATURE AND PRESSURE SENSORS

FIELD OF THE INVENTION

This invention is in the field of forced warm air furnaces. Specifically, it is in the field of forced warm air furnaces for zone controlled heating.

BACKGROUND OF THE INVENTION

Forced air furnaces for zone controlled systems generally utilize external controls to determine when the furnace will be on and off. In this case, the furnace is generally in either a standby condition, or in an on condition in which it is running at full capacity. No direct control of the heat output rate of the furnace is made at the furnace. This causes duct noise and erratic temperature changes within the zones. The object of Applicants' invention is to control the pressure in the heat exchanger for a more constant output over the normal range of the heating loads. This is accomplished by allowing the furnace to run well below the full firing rate and have the circulation blower running at a reduced speed. The result will be less duct noise, a more constant temperature in the living space, and at low loads the greater on time per cycle will improve air circulation. For example, an electrically-commutated motor (ECM) keeps high efficiency at low speeds, and since the power required varies as the square of the speed, the energy efficiency improves at reduced speeds. It is also expected that the life of the motor and heat exchanger will improve.

SUMMARY OF THE INVENTION

This invention is a system which utilizes analog sensors to control furnace operation to obtain the following benefits: improved economy; simplified and improved zone control; more uniform temperature control; improved air circulation when heating load is low; low noise operation; and increased furnace life.

The primary control in this system is an analog pressure sensor in the heat exchanger that holds heat exchanger pressure to a setpoint that can be controlled according to the heating load. A pressure sensor alone can regulate the air delivery to the load, but by itself it could cause the heat exchanger to overheat. Therefore, the system also uses an analog sensor to measure heat exchanger temperature and that information is used to control the firing rate. A similar system is utilized in a single zone system described in co-pending, commonly owned, patent application entitled, "Adaptive Furnace Control using Analog Temperature Sensing", Ser. No. 07/973,794, filed on the same date as the present application, and hereby incorporated by reference. A microprocessor utilizes an A/D convertor to measure the sensors and pulse width modulation to control the actuators. One function of the microprocessor is to keep history of duty cycles and to use that information to adjust heat exchanger pressure setpoint to provide proper heat delivery for varying heat loads.

DESCRIPTION OF THE PREFERRED EMBODIMENT

Figure 1:
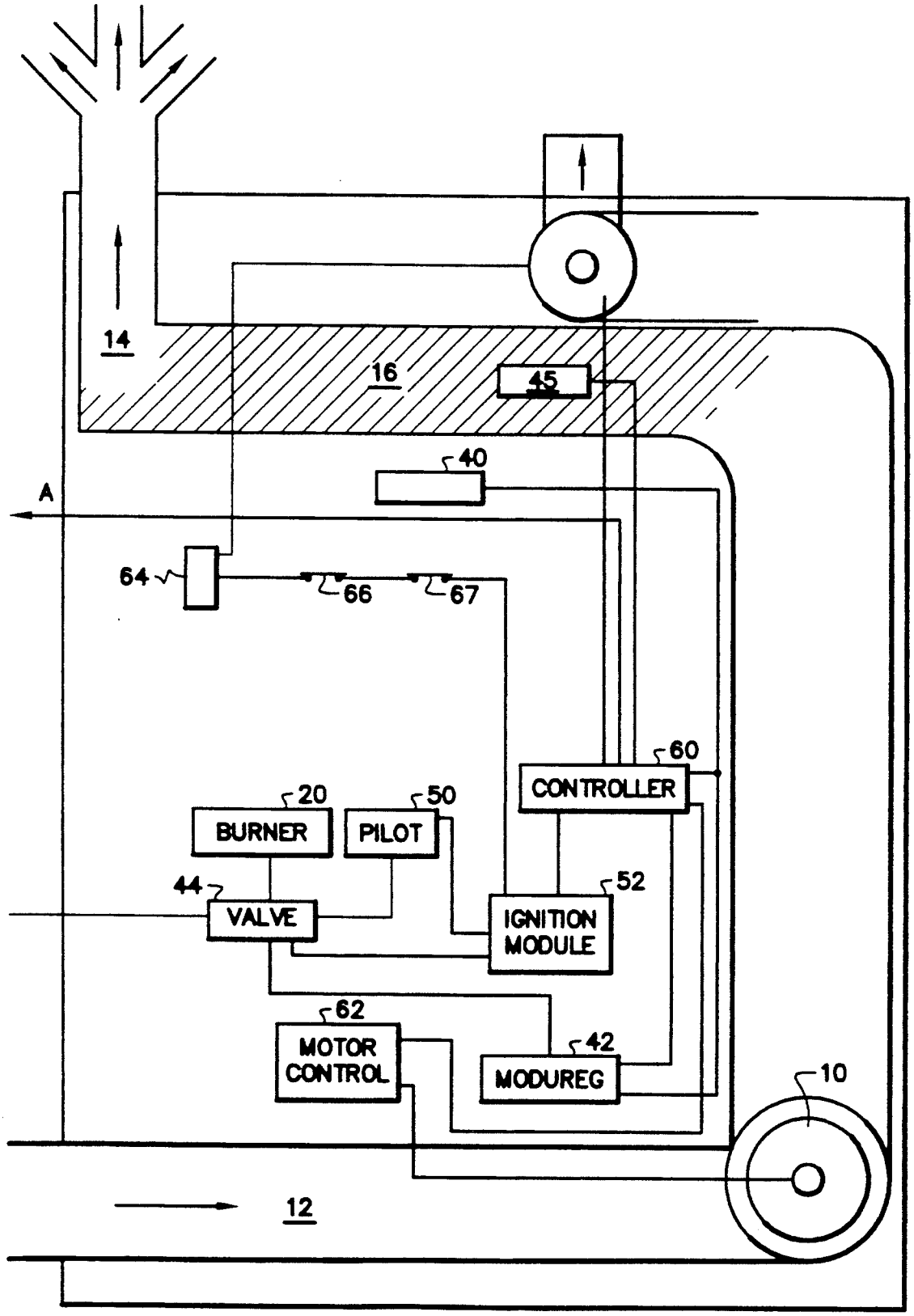
FIG. 1 illustrates a typical furnace which incorporates the invention.

FIG. 1 illustrates the implementation of Applicants' invention into a furnace design for zoned heating. The furnace comprises circulation blower 10, burner 20, induced draft blower 30 and valve 44. In general, the operation of Applicants' invention is similar to a standard furnace; wherein returned air is brought through return duct 12 and pressurized using blower 10 so that it is forced through warm air ducts 14 and delivered to the zones to be heated. As the air passes through the furnace, it passes through heat exchanger 16 where it is heated before entering warm air duct 14. Heat exchanger 16 is heated utilizing burner 20. Burner 20 generally utilizes either natural gas or oil. Burner 20 mixes and burns fuel and air which is brought through the heat exchanger by induced draft blower 30. These combustion product gases are then expelled out of the furnace through exhaust chimney 32. In a zoned application of a conventional furnace, burner 20 is turned on whenever a request for heat is received at controller 60 from an outside control unit. When no request for heat is provided, valve 44 does not provide fuel to burner 20. When a request for heat is received, burner 20 runs at a preset level and blower 10 will run at full speed, providing forced warm air to the zone until the request for heat is satisfied. In normal operation, the furnace has little or no control over the circulation air pressure.

In zone controlled heating systems, the pressure within the ducts is affected by the number of zones requesting heat and whether any of the ducts are blocked. Applicants' invention is able to monitor the pressure level at heat exchanger 16 utilizing pressure sensor 45. Pressure sensor 45 detects a pressure at heat exchanger 16 and provides this information to controller 60. Controller 60 sends a control signal to motor control 62 which regulates the speed of blower 10, so as to keep pressure constant at heat exchanger 16. Pressure sensor 45 is a Honeywell Microbridge Flow Sensor calibrated to measure differential air pressure relative to ambient air pressure. Blower 10 utilizes an ECM variable speed motor that is controlled by pulse width modulation provided by motor control 62. Honeywell Microbridge Flow Sensor is manufactured by Honeywell Inc., Microswitch Division.

In the operation of Applicants' invention, a temperature sensor 40, a thermistor, measures the air temperature in heat exchanger 16 and provides a signal to Modureg 42. Although Applicants use a thermistor for temperature sensor 40, any temperature sensitive means may be used, including, but not limited to, variable resistive means, thermocouples, and bimetal sensors. If a temperature sensor is not used, the system may overheat, opening high limit contact 66. Modureg 42 regulates burner 20 to maintain a constant temperature at heat exchanger 16. Modureg 42, regulates valve 44 and thereby modulates burner 20 such that heat exchanger 16 is held at a constant 120° F. during the "on" portion of the cycle. Modureg 42 is a product that is made to take an input from a thermistor and control a modulating gas valve. The valve control signal in this case is a variable current provided by Modureg 42. The Modureg circuit utilized in this application is manufactured by Honeywell Inc., Home and Building Controls Division. Valve 44 controls the fuel flow which is provided to burner 20 and to pilot 50. Pilot 50 is ignited by ignition module 52. Although Applicants' invention utilizes Modureg 42, Modureg 42 could be replaced by any control system that will modulate valve 44 proportional to heat exchanger 16 temperature.

A voltage proportional to heat exchanger 16 temperature is fed to a comparator to create an on/off signal to controller 60 for blower 10. Controller 60 will not allow blower 10 to operate until heat exchanger 16 temperature is over 90° F. This allows blower 10 to run only when the air in duct 14 is warm enough to be comfortable.

The ignition and primary safety of this system is provided by ignition module 52 Although most ignition modules known to persons skilled in the art will work satisfactorily for this invention, Applicants utilized a Model S89 ignition module produced by Honeywell Inc., Home and Building Controls Division.

Pressure switch 64 measures the differential pressures at induced draft blower 30. Pressure switch 64 measures the differential air pressure created by induced draft blower 30 with respect to the ambient air pressure. In this manner, the furnace is able to determine whether there is an adequate induced air flow to operate the furnace. If an insufficient induced air flow is present, contact 67 will open cutting off power to an ignition module 52 and closing valve 44. Contact 66 opens if heat exchanger 16 temperature increases dramatically over the setpoint temperature, generally 120° F. Similar to contact 67, contact 66 shuts down ignition module 52 and closes valve 44.

Figure 2:
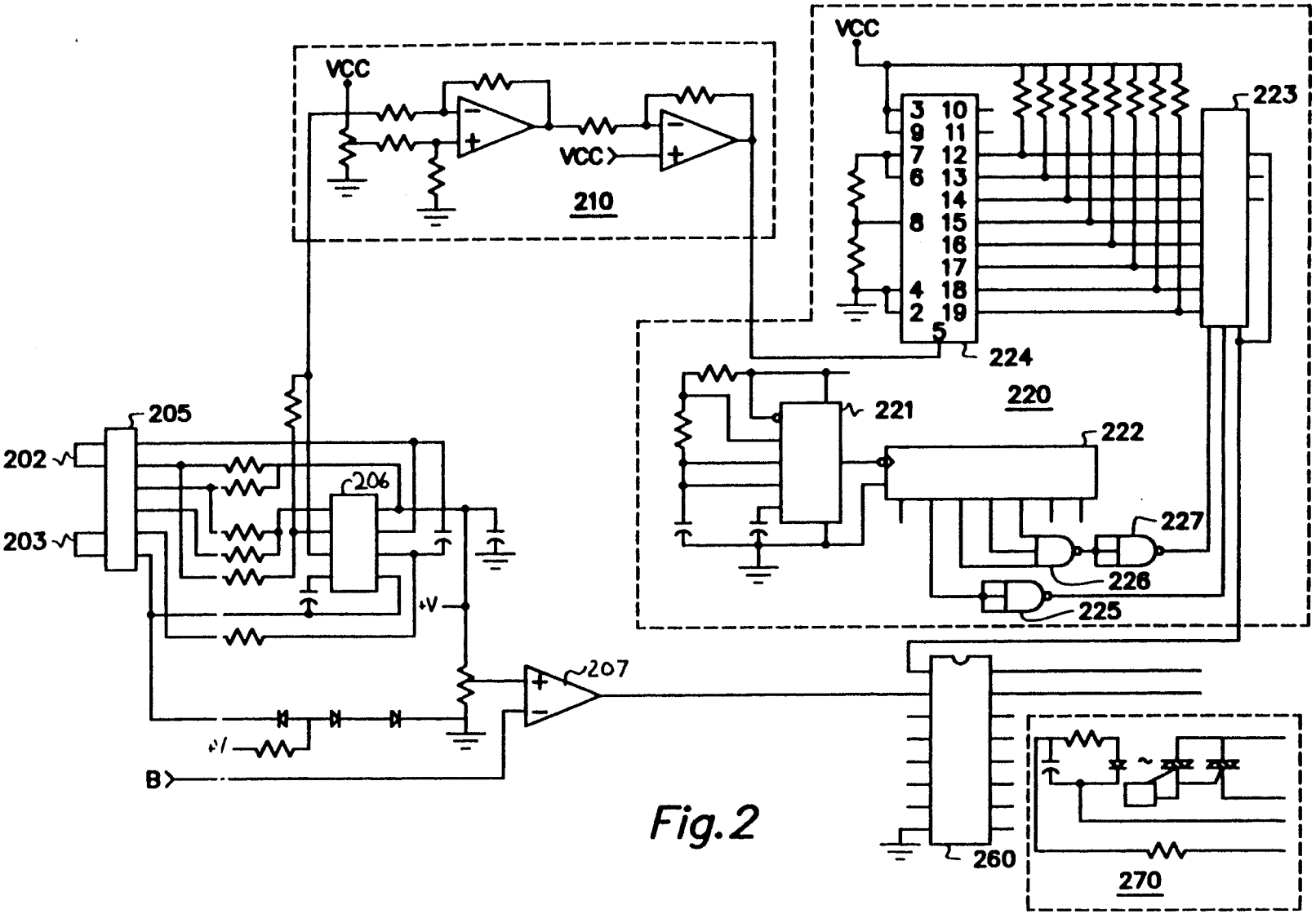
FIG. 2 illustrates a schematic diagram of the controller.

FIG. 2 is a schematic diagram of controller 60. Heat exchanger 16 pressure is input at node 202 into microbridge 205. The output of microbridge 205 is amplified by amplifier 206. Atmospheric pressure is input into node 203. Microbridge 205 then converts this to a differential pressure. This differential pressure is transmitted through buffer 210, which is made up of two LM324 operational amplifiers, manufactured by National Semiconductor Inc., and the necessary resistors. The output of buffer 210 is fed to a pulse modulation circuit 220. Pulse modulation circuit 220 is made up of free running oscillator 221, counter 222, shift register 223, sequential output 224, and "nand" gates 225, 226 and 227. Sequential output 224 utilizes an LM3914, manufactured by National Semiconductor Inc., which is a circuit that was initially designed for sequential lighting of segments of a LED light bar according to an analog signal on pin 5. Buffer 210 inputs the differential pressure signal into pin 5 of sequential output 224. The outputs of sequential output 224 are parallel loaded into shift register 223 which is then shifted out as a pulse width modulated signal that is proportional to the analog pressure signal. This signal is fed to darlington array 260 which is an MC1413, manufactured by Motorola Inc., and then to the opto isolator on ECM motor control 62. The induced draft blower 270 utilizes an MOC2A40, manufactured by Motorola Inc., which is an optically isolated triac with zero crossing detect. Node B is an input from Modureg 42 which is provided directly to darlington array 260 and further provided to motor control 62. The signal from node B is provided to comparator 207. If the input from node B represents a temperature of 90° F. or more, an enable signal is provided to motor control 62 in order to prevent blower 10 from circulating air through the system until heat exchanger 16 reaches an operating temperature.

Figure 3:
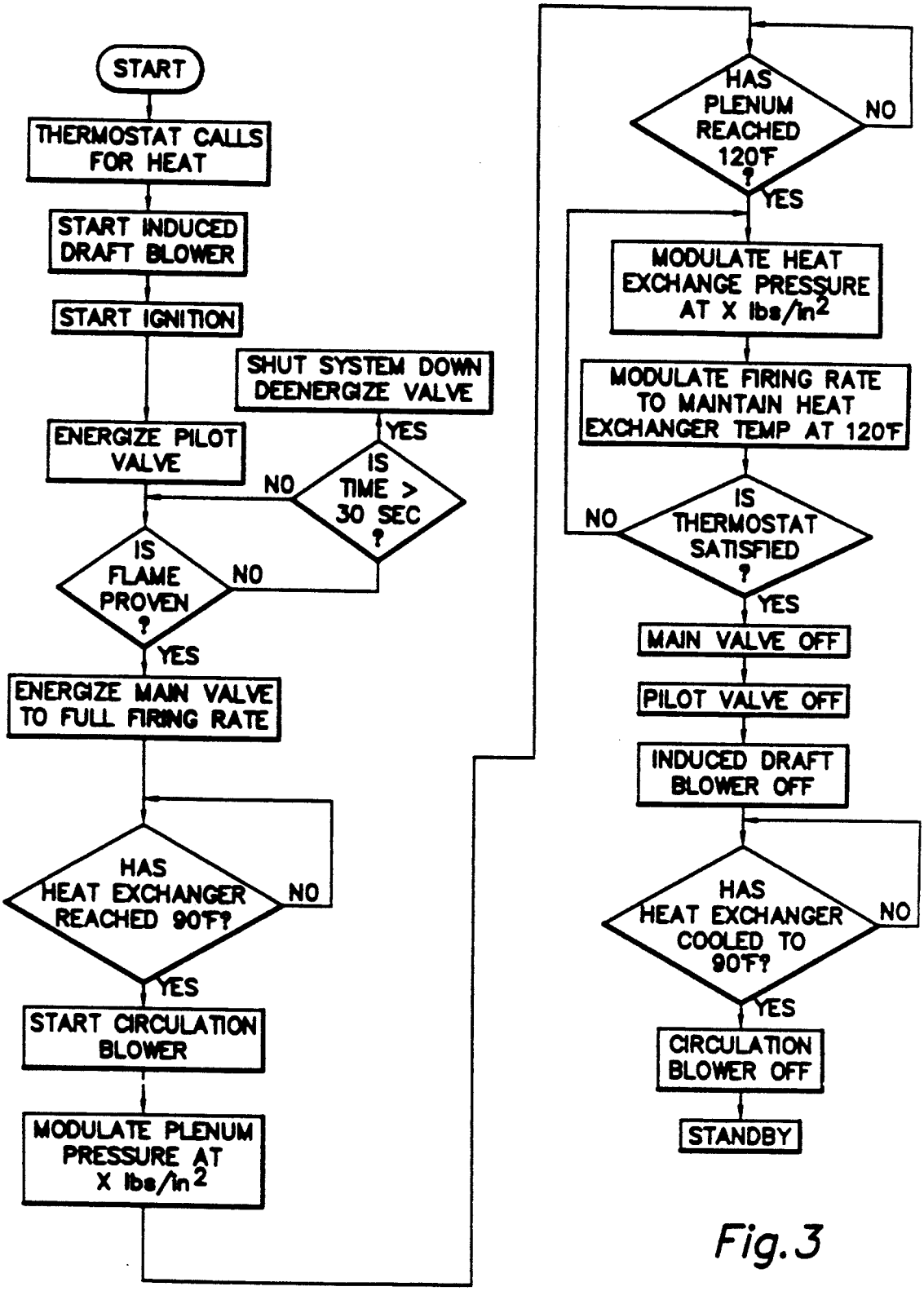
FIG. 3 illustrates a flow diagram showing the operation of the furnace.

FIG. 3 is the flow chart for operation of the system. During standard operation, the system will be in standby until a call for heat is received from the external controller. Upon receiving a call for heat, controller 60 energizes induced air draft blower 30. Ignition module 52 is then energized and valve 44 provides fuel to pilot 50. A thirty second period is then timed out while the system checks to see if a pilot flame has been proven at pilot 50. If no flame is proven after thirty seconds, valve 44 closes and the system shuts down. Upon a pilot flame being proven at pilot 50, main valve 44 provides fuel to burner 20. A high fire period (to minimize condensation) then follows while heat exchanger 16 is heated. Upon heat exchanger 16 reaching an initial temperature of 90° F., circulation blower 10 is energized by controller 60. Pressure sensor 45 provides a constant differential pressure to controller 60, such that the pressure located within heat exchanger 16 is held constant. Burner 20 continues to heat, heat exchanger 16 until heat exchanger 16 reaches an operating temperature of 120° F. Upon heat exchanger 16 reaching an operating temperature of 120° F., temperature sensor 40 alerts Modureg 42 which modulates valve 44 to burner 20 in order to keep a constant temperature of 120° F. at heat exchanger 16. Heat exchanger 16 pressure is also monitored in order to keep a constant air pressure in heat exchanger 16. Upon the external control being satisfied, main valve 44 is turned off to both burner 20 and pilot 50. Induced draft blower 30 is then de-energized by controller 60. Heat exchanger 16 then cools to 90° F., at which time, circulation blower 10 is de-energized and the furnace returns to a standby condition.

In the event that the history recorded in a microprocessor located in controller 60 indicates increasing or decreasing average duty cycles for the furnace, heat exchanger 16 pressure setpoint will be correspondingly increased or decreased, accordingly. This average should be over several days to avoid errors due to setup or setback. A second alternative to adjusting pressure setpoint based on duty cycle is to time the current "on" time of the furnace. If the current "on" time recorded by a microprocessor located in controller 60 is longer than a preselected time, controller 60 will increase the pressure setpoint. In this manner, as the heating load increases due to the change in seasons, the furnace will increase output accordingly. A minimum "on" time will also be maintained to account for decreases in heat load.

We claim:

1. A method for regulating circulation blower setpoints to maintain constant pressure in a forced air zoned heating system the forced air furnace having return ducts, a heat exchanger, warm air ducts, a circulation blower, and a burner, comprising the steps of:

receiving a heating request from an external controller;

energizing the burner in the furnace to heat the heat exchanger;

sensing the temperature of the heat exchanger;

energizing the circulation blower when the heat exchanger reaches a first predetermined temperature;

regulating the burner to maintain a second predetermined temperature, said second predetermined temperature being higher than said first predetermined temperature;

sensing the pressure in the heat exchanger;

regulating the circulation blower at a circulation setpoint to maintain a constant pressure in the heat exchanger;

de-energizing the burner when said heating request is satisfied; and de-energizing the circulation blower when said heat exchanger cools to said first predetermined temperature.

2. A method for regulating circulation blower setpoints to maintain constant pressure in a forced air zoned heating system the forced air furnace having return ducts, a heat exchanger, warm air ducts, a circulation blower, and a burner, comprising the steps of:

receiving a heating request from an external controller;

energizing the burner in the furnace to heat the heat exchanger;

energizing the circulation blower;

sensing the pressure in the heat exchanger;

regulating the circulation blower at a circulation setpoint to maintain a constant pressure in the heat exchanger;

measuring the time required to satisfy said heating request;

increasing the circulation blower setpoint to maintain a second constant pressure if said time required to satisfy said heating request increases;

decreasing the circulation blower setpoint to maintain a third constant pressure if said time required to satisfy said heating request decreases; and de-energizing the burner and the circulation blower when said heating request is satisfied.

3. The method for regulating circulation blower setpoints of claim 2 further comprising the steps of:

sensing the temperature of the heat exchanger;

energizing the circulation blower when the heat exchanger reaches a first predetermined temperature;

regulating the burner to maintain a second predetermined temperature, said second predetermined temperature being higher than said first predetermined;

de-energizing the burner when said heating request is satisfied;

de-energizing the circulation blower when said heat exchanger cools to said first predetermined temperature.

4. A method for regulating circulation blower setpoints to maintain constant pressure in a forced air zoned heating system the forced air furnace having return ducts, a heat exchanger, warm air ducts, a circulation blower, and a burner, comprising the steps of:

receiving a heating request from an external controller;

energizing the burner in the furnace to heat the heat exchanger;

energizing the circulation blower;

sensing the pressure in the heat exchanger;

regulating the circulation blower at a circulation setpoint to maintain a constant pressure in the heat exchanger;

measuring cycle "on " time of said furnace;

increasing said circulation blower setpoint to maintain a second constant pressure if said "on " time increases;

decreasing said circulation blower setpoint to maintain a third constant pressure if said "on " time decreases;

de-energizing the burner and the circulation blower when said heating request is satisfied.

5. The method for regulating circulation blower setpoints of claim 4 further comprising the steps of:

sensing the temperature of the heat exchanger;

energizing the circulation blower when the air temperature in the heat exchanger reaches a first predetermined temperature;

regulating the burner to maintain a second predetermined temperature, said second predetermined temperature being higher than said first predetermined;

de-energizing the burner when said heating request is satisfied;

de-energizing the circulation blower when said heat exchanger cools to said first predetermined temperature.

6. A furnace control for a forced air control heating system for multi-zone heating, the forced air furnace having return ducts, a heat exchanger, warm air ducts, a circulation blower, and a burner, the forced air furnace receiving the heating requests for external control means, wherein said furnace provides heat to at least one zone to be heated, the burner heating the heat exchanger, the circulation blower forcing air from the return ducts through the heat exchanger and out the warm air duct to the zone to be heated, said furnace control comprising:

temperature sensor for sensing the temperature of the heat exchanger;

regulation means for regulating the burner, said temperature sensor providing a signal representative of the air temperature in the heat exchanger to said regulation means, said regulation means regulating the burner such that said heat exchanger is held to a constant temperature after reaching a preset temperature during the external controller request for heat;

a pressure sensor for measuring the pressure in the heat exchanger;

a controller for controlling the circulation blower, said pressure sensing means providing a signal representative of said pressure in the heat exchanger to said controller, said controller regulating the circulation blower wherein said pressure in the heat exchanger is held constant; and wherein said controller further comprises timing means, wherein said furnace satisfies said request for heat in a period of time, wherein said timing means times said period of time, said controller increasing said pressure if said period of time is greater than a first predetermined time.

7. The furnace control of claim 6 wherein said controller decreases said pressure if said period of time is less than a second predetermined time.

* * * * *

UNITED STATES PATENT AND TRADEMARK OFFICE

CERTIFICATE OF CORRECTION

PATENT NO. : 5,307,990

DATED : May 3, 1994

INVENTOR(S) : WILMER L. ADAMS; RALPH H. TORBORG

It is certified that error appears in the above-identified patent and that said Letters Patent is hereby corrected as shown below:

Column 6, line 6, after "decreases;" insert --and--.

line 11, before "temperature" insert --air--.

line 28, after "receiving" delete --the--.

line 28, change "for" to --from--.

line 35, before "temperature" (first occurrence) insert --a--.

line 45, delete "a".

Signed and Sealed this

Thirtieth Day of August, 1994

*Attest:*

*Attesting Officer*

Bruce Lehman

BRUCE LEHMAN

*Commissioner of Patents and Trademarks*